US007444906B2

(12) United States Patent
Thirouin

(10) Patent No.: US 7,444,906 B2
(45) Date of Patent: Nov. 4, 2008

(54) DEVICE FOR IDENTIFYING CLAMPING TOOLS

(75) Inventor: Stéphane Denis Thirouin, Paris (FR)

(73) Assignee: Facom, Morangis (FR)

( * ) Notice: Subject to any disclaimer, the term of this patent is extended or adjusted under 35 U.S.C. 154(b) by 304 days.

(21) Appl. No.: 10/514,417

(22) PCT Filed: May 14, 2003

(86) PCT No.: PCT/FR03/01467

§ 371 (c)(1),
(2), (4) Date: Nov. 15, 2004

(87) PCT Pub. No.: WO03/097302

PCT Pub. Date: Nov. 27, 2003

(65) Prior Publication Data

US 2005/0155466 A1 Jul. 21, 2005

(30) Foreign Application Priority Data

May 16, 2002 (FR) ..... 02 06051

(51) Int. Cl.
*B25B 13/58* (2006.01)

(52) U.S. Cl. ..... 81/180.1; 81/467; 81/468; 81/473; 81/476; 81/477; 81/479

(58) Field of Classification Search ..... 81/180.1, 81/467, 468, 473, 476, 477, 478, 479
See application file for complete search history.

(56) References Cited

U.S. PATENT DOCUMENTS

| | | | | |
|---|---|---|---|---|
| 3,808,918 | A | 5/1974 | Carr | |
| 4,062,137 | A * | 12/1977 | Herzog | 40/657 |
| 4,800,786 | A * | 1/1989 | Arnold et al. | 81/121.1 |
| 5,330,230 | A * | 7/1994 | Craig | 283/81 |
| 5,819,606 | A | 10/1998 | Arnold | |
| 5,957,012 | A | 9/1999 | McCune | |
| 6,257,098 | B1 * | 7/2001 | Cirone | 81/119 |

FOREIGN PATENT DOCUMENTS

EP 1 077 114 2/2001

* cited by examiner

*Primary Examiner*—Joseph J. Hail, III
*Assistant Examiner*—Shantese L McDonald
(74) *Attorney, Agent, or Firm*—Jacobson Holman PLLC

(57) ABSTRACT

A device for marking or identifying a female recess tool for clamping a mobile element (such as a nut), characterized in that it is adapted to be completely inserted in the female recess and maintained therein by frictional forces. It is then easy to identify, for example, features peculiar to the tool.

17 Claims, 2 Drawing Sheets

DEVICE FOR IDENTIFYING CLAMPING TOOLS

This is a national phase of PCT/FR03/01467 filed May 14, 2003 and published in French.

FIELD OF THE INVENTION

The present invention relates to a device for marking or identifying tools with female recess, enabling mobile elements (such as a nut) to be clamped. In non-exhaustive manner, it is question of the class of tools of sockets and tube wrenches.

BACKGROUND OF THE INVENTION

In effect, it is appreciable to identify these tools in a case or box, in the desired dimension (for example metric), as rapidly as possible.

According to the prior art, such identification is made thanks to a figure inscribed on the very tool, generally on its part adapted to be gripped.

However, this figure is often difficult to read by the users due to its small dimensions and to the dirt which might be deposited on the tool when used.

In an attempt to solve this problem, U.S. Pat. No. 5,819,606 discloses devices for marking or identifying sockets constituted by a cylindrical ring which is inserted in a female recess in the socket arranged in the part opposite the female recess of the nut. Identification is then effected thanks to a specific colour of the ring or to a figure inscribed on its upper surface.

However, this device is not entirely satisfactory since it cannot be generalized to other types of tools such as tube wrenches, the figure inscribed on the ring is of small dimensions, being located on a very narrow surface, and identification by color means that a colors code has to be memorized.

These problems have been partly solved by U.S. Pat. No. 5,957,012 by the creation of a plug of shape and size complementary to that of the female recess of the nut.

However, this plug must be removed each time before the tool is used.

Moreover, this device adds difficulty since it is in that case necessary, in a first step, to find the plug corresponding to the desired shape, then, in a second step, to look for the desired tool.

SUMMARY OF THE INVENTION

In this context, the present invention overcomes the drawbacks of the prior art by proposing an easily legible device connected by insertion in any type of tools for clamping mobile elements and not preventing usual use of the tool.

Moreover, the device according to the invention is adapted to existing tools without modification thereto.

The device for marking and identifying a female recess tool for clamping a mobile element (such as a nut) is characterized in that it is adapted to be completely inserted in the recess and to be maintained therein by securing means.

In order to simplify the use of the tool and to ensure an inexpensive securing of the device, the securing means employ forces of friction which are generated by rubbings between the inner wall of the female recess and the lateral surface of the device due to the fact that the device has a shape which is either complementary to the shape of the recess of the tool, or circumscribed in the shape of said recess, or included in the shape of said recess.

In order to minimize the space occupied by the device in the recess of the tool and thus allow the tool to be used as usual, the device is made so that one of its dimensions is much smaller than its other two located in a plane perpendicular to the axis of clamping of the mobile element.

So as to create low production costs and simple processes of manufacture, the device is constituted by a semi-rigid pellet, for example made of plastics material (particularly polycarbonate) or of metallic material (for example aluminum) whose thickness is included between 0.1 and 1.5 mm (preferably between 0.3 and 0.5 mm) and is concave in shape.

In order to allow a rapid identification of the tool to be used, the pellet presents information relative to the dimension of the tool, namely a figure inscribed on at least one of its faces, preferably both in order thus to allow the pellet to be reversed.

Moreover, with a view to using the same pellet with different tools, the securing means are removable.

In this way, thanks to the invention, both a socket and a tube wrench in the desired dimension can therefore be rapidly identified.

Advantageously, the pellets are constituted by a multilayer material which comprises a layer of plastics or metallic material, at least one layer of ink and a layer of protective material, such as a varnish.

BRIEF DESCRIPTION OF THE DRAWINGS

The invention will be more readily understood in the light of the following description relating to an illustrative and in no way limiting form of embodiment, with reference to the accompanying drawings, in which.

DETAILED DESCRIPTION OF THE PREFERRED EMBODIMENTS

Figure 1:
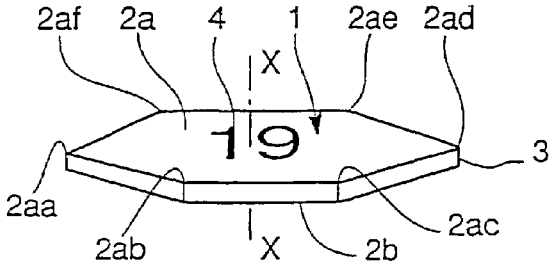
FIG. 1 is a view in perspective of an embodiment of the device according to the invention, in the form of a pellet.

FIG. 1 is a view in perspective of a form of embodiment of the device according to the invention, shown here in non-exhaustive manner in the form of a pellet 1.

The pellet 1 comprises two parallel faces, an upper face 2*a* and a lower face 2*b*.

The pellet 1 also presents an axis X-X transverse with respect to the pellet and which passes through the centre of said faces (2*a*, 2*b*).

In accordance with the particular representation of the device according to the invention in FIG. 1, the parallel faces 2*a* and 2*b* lie at a distance from each other which is called thickness 3.

The face 2*a* (respectively 2*b*) of the pellet 1 is of hexagonal shape, with apices 2*aa*, 2*ab*, 2*ac*, 2*ad*, 2*ae* and 2*af* (respectively 2*ba*, 2*bb*, 2*bc*, 2*bd*, 2*be* and 2*bf*).

The faces 2*a* and 2*b*, as well as apices 2*aa*, 2*ab*, 2*ac*, 2*ad*, 2*ae* and 2*af* perform equivalent roles, i.e. said faces are identical to each other and said apices identical to one another.

The faces of the pellets may generally take very varied shapes. Other possible forms of embodiment of a pellet will be seen hereinbelow.

The thickness 3 is of very small dimensions with respect to the distance separating two opposite apices of the same face, i.e. the distance separating apices 2*aa* and 2*ad* for example.

The thickness 3 is of the order of some tenths of millimeters. It is included between 0.1 and 1.5 mm, preferably between 0.3 and 0.5 mm.

At least one of the faces (2*a*, 2*b*) bears an inscription 4 which is either a figure, or a name or a logo, a reference, a designation, etc. . . .

Said inscription 4 is represented in FIG. 1, in accordance with an illustrative and in no way limiting embodiment, in the form of the FIG. 19. This illustrative embodiment will be retained in the following in the Figures using the pellet 1.

Figure 2:
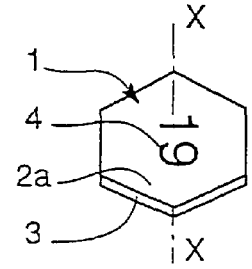
FIG. 2 is an exploded view in perspective of the pellet and of a socket in which it is to be inserted.
Figure 2:
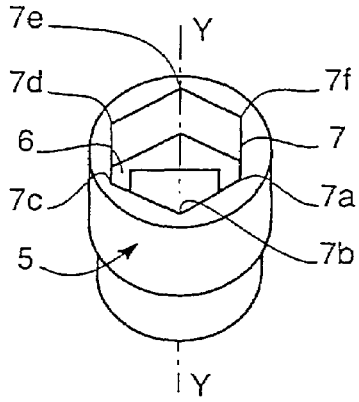

FIG. 2 is a view in perspective of the pellet and of the female recess tool for clamping a mobile element in which it is to be inserted.

The female recess tool, shown in FIG. 2, is a socket 5 of known type and the mobile element associated with said tool is a nut (not shown).

Elements which are identical or similar to those of FIG. 1 bear the same references.

The socket 5 presents a female recess 6 adapted to cooperate with a nut (not shown).

The female recess 6 presents an axis Y-Y, called clamping axis and, seen in cross section, a substantially hexagonal section.

Axis Y-Y defines the axis of clamping of the nut about which a couple of forces must be exerted in order to clamp the nut in another element.

During the insertion of the pellet 1 in the female recess 6, axes X-X and Y-Y are substantially colinear and merge when the pellet 1 is located in said female recess 6.

The pellet 1 presents a shape which is either complementary to the shape of the female recess 6, or circumscribed in the shape of the female recess 6, or included in the shape of the female recess 6.

The pellet 1 has been shown in FIGS. 1 and 2 with a shape complementary to the female recess 6. In this way, depending on the particular form of embodiment of the device according to the invention in FIG. 2, as the cross section of the orifice 7 is of hexagonal shape, the pellet 1 in that case presents a hexagonal shape.

The hexagon defined by the cross section of the orifice 7 presents six apices 7*a*, 7*b*, 7*c*, 7*d*, 7*e* and 7*f*.

The distance separating two opposite apices of the face 2*a* (for example 2*aa* and 2*ad*) of the pellet 1 is slightly greater than the distance separating two opposite apices of the cross section of the orifice 7 (for example 7*a* and 7*d*).

In the calculation of said distances, the faces 2*a* and 2*b* of the pellet 1, the apices 2*aa*, 2*ab*, 2*ac*, 2*ad*, 2*ae* and 2*af*, the apices 2*ba*, 2*bb*, 2*bc*, 2*bd*, 2*be* and 2*bf* and the apices 7*a*, 7*b*, 7*c*, 7*d*, 7*e* and 7*f* perform equivalent roles, i.e. one of the two faces as well as two opposite apices from among the six corresponding to the face of the pellet previously chosen, may equally well be chosen for this calculation. The same applies to the apices of the hexagon defined by the cross section of the orifice 7 which all present the same characteristics (for example their angle).

In privileged manner, the pellet 1 is made of plastics material. The pellet 1 is thus made of polycarbonate for example.

However, the pellet 1 may equally well be made of a metallic material, particularly aluminum.

The pellet 1 may be secured to the female recess 6 by any known means such as glue, double-face adhesive, etc. . . .

According to an advantageous embodiment, securing of the pellet 1 inside the female recess 6 is effected thanks to forces of friction.

The pellet 1 is made for example of a semi-rigid material, which allows it to be deformed and to be inserted in the female recess 6 despite the difference in magnitude between the distance separating two opposite apices (for example 2*aa* and 2*ad*) of the face 2*a* of the pellet 1 and the distance separating two opposite apices (for example 7*a* and 7*d*) of the cross section of the orifice 7.

The semi-rigid nature of the pellet 1 also allows it to be secured to the female recess 6 by forces of friction that the walls of said female recess 6 exert on the pellet 1, and more particularly on its lateral surface, during insertion and deformation thereof in said recess 6.

Depending on the particular form of embodiment of the pellet 1, insertion of the pellet 1 in the female recess 6 is effected by exerting a thrust force in the direction of axis Y-Y on a face (2*a* or 2*b*) of the pellet 1 in order to allow it to enter in the female recess 6.

The user then continues to exert the thrust until the pellet 1 abuts against the bottom of the female recess 6.

The insertion of the pellet 1 in the female recess 6 is also rendered possible either by the complementarity of the shape of the pellet 1 with the shape of the female recess 6, or by the circumscription or the inclusion of the shape of the pellet 1 in the shape of the female recess 6.

In order to occupy very little space inside the female recess 6, and not to prevent use of the socket 5 as usual, the pellet 1 presents a thickness 3 of very small dimension with respect to the dimension of the depth of the female recess 6.

The pellet 1 is, in privileged manner, located in the bottom of the female recess 6 in order to allow optimum use of the socket 5. However, even if the pellet 1 is disposed at a certain distance from the bottom of the female recess 6 without touching the bottom of the female recess 6, it does not prevent use of the socket 5. In effect, during introduction of the nut in the female recess 6, the nut pushes the pellet 1 towards the bottom of the female recess 6.

Figure 3:
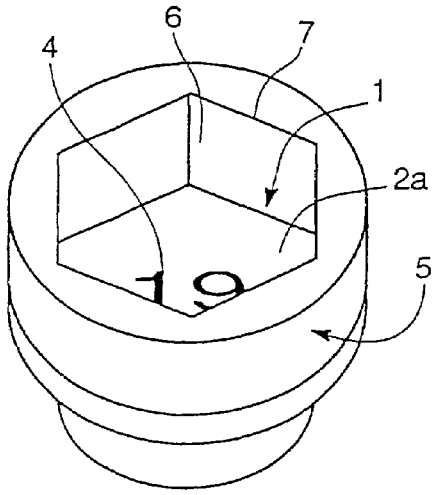
FIG. 3 is a view in perspective of the socket with the pellet in the bottom of its female recess.

FIG. 3 is a view in perspective of the socket of FIG. 2, with the pellet in the bottom of its female recess.

Elements identical or similar to those of FIGS. 1 and 2 bear the same references.

Once the pellet 1 is inserted in the female recess 6, the user can read the inscription 4 (represented in the Figure in non-exhaustive manner by the FIG. 19) written on the upper face 2*a* of the pellet 1. The inscription 4 is preferably information on the dimension (for example metric) of the socket 5.

The pellet 1 may present the same inscription 4 on its upper (2*a*) and lower (2*b*) faces. It is therefore reversible, the direction of insertion of the pellet 1 in that case being of no importance.

Figure 4:
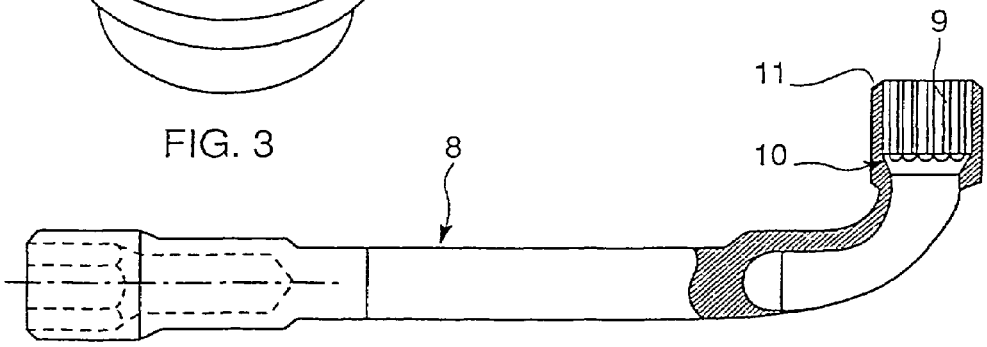
FIG. 4 is a schematic view in longitudinal cross section of a tube wrench with a pellet in the bottom of its female recess.

FIG. 4 schematically shows a cross section of a tube wrench with a pellet in the bottom of its female recess.

Like the socket 5, the tube wrench 8 also belongs to the class of tools allowing mobile elements (such as a nut) to be clamped.

The tube wrench 8 comprises a female recess 9 into which a device according to the invention, represented here by the pellet 10 similar to pellet 1 of FIGS. 1, 2 and 3, may be inserted.

According to the representation of the device of the invention in FIG. 4, the pellet 10 has a shape complementary to that of the orifice 11 of the tube wrench 8 in cross section.

According to the form of embodiment of the orifice 11 and the female recess 9, the pellet 10 may present the same geometrical characteristics as the pellet 1. Therefore the same pellet may be used equally well for a socket as for a tube wrench.

Different colors of pellets may be used in order to differentiate sets of tools. For example, if a pellet color is associated with a person, it is then possible to differentiate two tools which are identical but belong to two different users or then to find one's tool in the tool box of another person.

Figure 5:
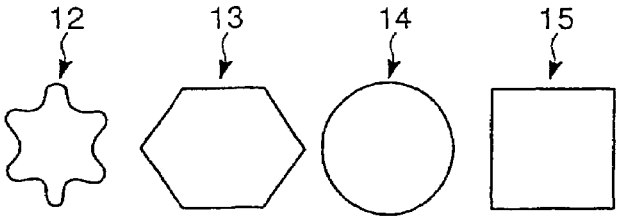
FIG. 5 is a plan view of different possible shapes of pellets.

FIG. 5 is a representation in plan view of different possible shapes of pellets.

Pellets 12, 13, 14 and 15 are all of different shapes. Their shape is determined in order to render possible the insertion of the pellet in the female recess of the tool.

The faces of the pellet 12 present a TORX® profile, the faces of the pellet 13 a hexagonal profile, the faces of the pellet 14 a circular profile and the faces of the pellet 15 a square profile.

The pellets 12, 13, 14 and 15 present on at least one of their two faces an inscription (not shown in FIG. 5) which is either a figure, or a name or a logo, a reference, a designation, etc. . . .

Generally, the faces of the pellets may present circular, triangular, quadrangular (of square or rectangular type), pentagonal, hexagonal, heptagonal, octogonal, polygonal, etc. shapes.

Moreover, the pellet having the same shape as the inlet orifice of the female recess of the tool or having a shape circumscribed or included in the shape of the female recess in which it is to be inserted, the faces of the pellet always present at least one of their characteristic distances (the diagonal for a square . . . pellet) very slightly greater than the same characteristic distance of the shape of the inlet orifice or than the distance corresponding to the circumscription or to the inclusion of the pellet.

In this way, the diagonals of the faces of the pellet 15 of square profile are greater than the diagonals of the inlet orifice of square shape of the female recess in which it is to be inserted.

Moreover, due to the fact that the pellet may present a shape circumscribed or included in the shape of the female recess, a pellet of hexagonal shape may serve as device for marking and identifying a socket having a hexagonal or bihexagonal (so-called 6 sided or 12 sided) section. In the case of a bihexagonal female recess, a pellet of hexagonal shape may therefore be inserted; the shape of the pellet is included in the shape of the female recess.

A circular pellet may also be inserted in a female recess of hexagonal or bihexagonal shape. In this precise case, the diameter of the pellet is greater than the length of one of the sides of the hexagon or of the bihexagon defined by the recess of the tool.

Figure 6:
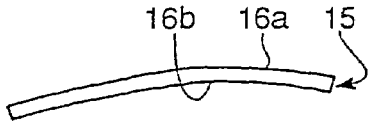
FIG. 6 is a transverse section though the pellet.

FIG. 6 is a representation of a transverse section of the pellet in accordance with another form of embodiment.

The pellet 15 presents a convex upper face 16*a* and a concave lower face 16*b*.

The concavities of the faces 16*a* and 16*b* make it possible to facilitate the insertion of the pellet 15 in the female recess of the tool by inserting the pellet 15 in the female recess of the corresponding tool by pushing on the face 16*b* of the pellet.

The concavity of the pellet 15 allows optimum securing thereof in the female recess due to the presence of stresses generated by the concavity.

In general, the pellets may, if necessary, be removed from their female recess by any known means (application of a thrust force on the lower face of the pellet with the aid of a metal rod, . . . ).

Figure 7:
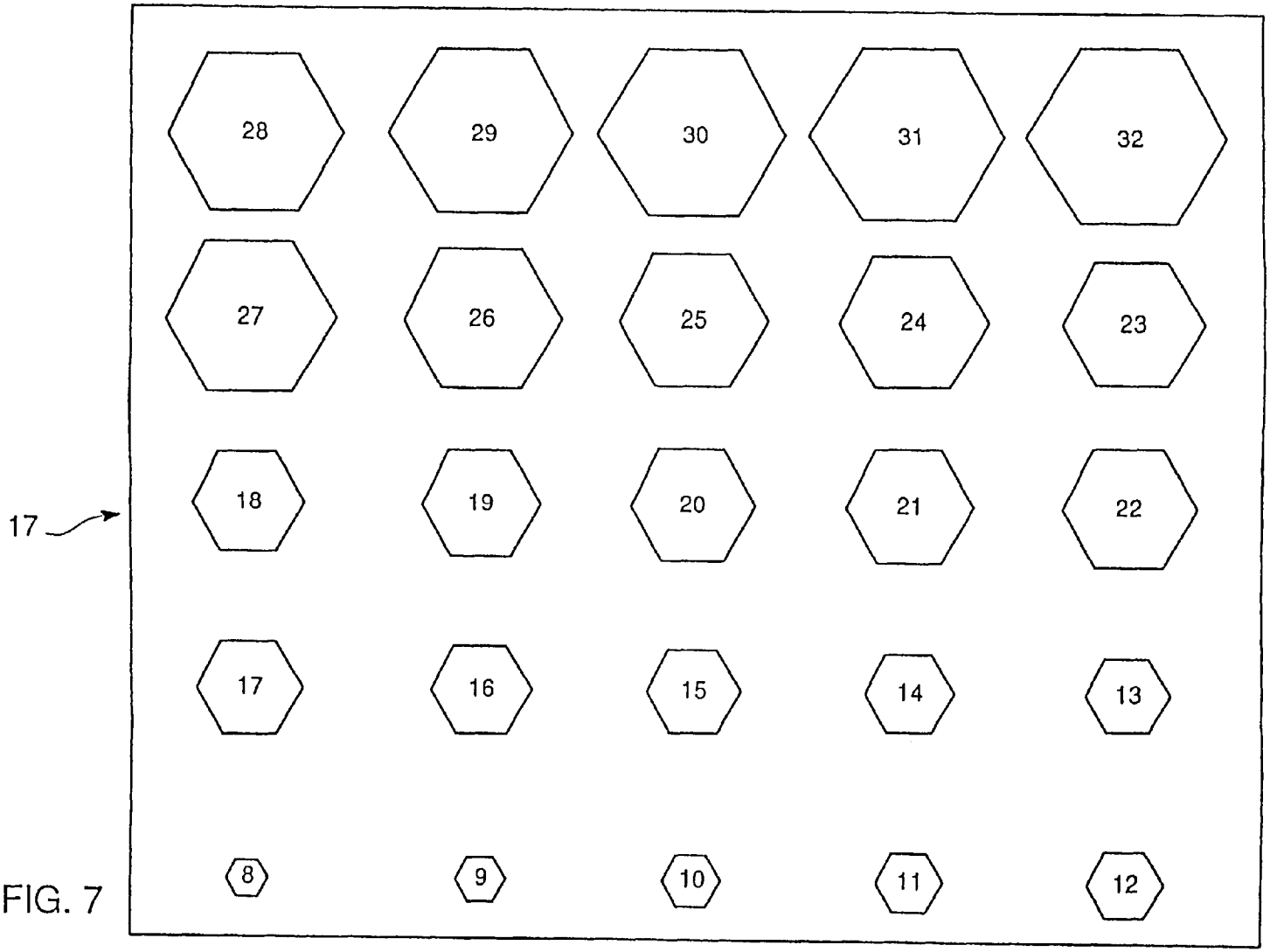
FIG. 7 a plan view of a sheet of pre-cutout pellets.

FIG. 7 is a plan view of a board of pre-cutout pellets.

The pellets are formed from a board 17.

The board 17 is constituted by multi-layer material.

The process for manufacturing the multi-layer board 17 consists in the printing of a text on a layer of material which may either be plastic (of the polycarbonate type), or metallic (of the aluminum type), then in the passage of a protection material such as a varnish.

It is, for example possible to take a board 17 of plastics material (of the polycarbonate type) on which is printed a layer of ink corresponding to the text which it is desired to appear on the front face of the board 1. There is then added thereon background ink corresponding to the colour which it is desired to give the pellet, then another layer of ink is added, corresponding to the text which it is desired to appear on the rear face of the board. Finally, a layer of finishing varnish is applied in order to protect everything. In a last step, the board is stamped in order to obtain a series of pre-cutout pellets each having an inscription on their rear face and on their front face, on condition that the layers of ink were well applied in correspondence with the stamping of the board. A vitrophane printing on polycarbonate has thus been produced if the board was based on that matter.

Vitrophane printing on metallic material is effected slightly differently. In effect, from a board, for example of aluminum, a layer of ink is applied on each face of said board, one face corresponding to the front-face inscription and another to the rear-face inscription. A finishing varnish is then applied on each face of the board. As for the last step of stamping, it remains the same as hereinabove.

It is also possible to effect this printing from a board of plastics material (for example polycarbonate) on which is added a layer of ink then another layer of ink corresponding to the nature of the background (for example calorimetric) which it is desired to appear on the pellet then a layer of finishing varnish.

This latter printing may be also be effected on a board of metallic material (for example of aluminum), but without carrying out the step of printing the layer of ink corresponding to the nature of the background.

In accordance with the particular mode of representation of the board, which is in no way limiting, in FIG. 7, the pellets shown are of hexagonal shape and increasing in size, i.e. going from size 8 to size 32. Pellets of all sizes and all possible shapes may be formed by this process.

As the pellets are pre-cutout in the board 17, a slight pressure on one of their faces enables them to be extracted from the board and thus to be used.

The invention claimed is:

1. In combination, a tool having a female recess with a bottom having a nut engaging surface for clamping a mobile element and a planar identification device, said planar identification device including a pellet identifying said tool by an inscription containing information relative to dimensions of said tool, said pellet being located completely inside the female recess of said tool and spanning without a hole across the recess, said pellet being secured only by friction between a lateral surface of said pellet and an inner wall of said female recess at the bottom of the recess, the pellet having a same shape as a cross section of the female recess, the pellet having side surfaces extending orthogonal relative to an upper and lower face of the pellet.

2. In combination, the tool and the identification device of claim 1, wherein the pellet includes a convex upper face and a concave lower face.

3. In combination, the tool and the identification device of claim 1, wherein the pellet is reversible.

4. In combination, the tool and the identification device of claim 1, wherein the pellet is constituted by a multi-layer material.

5. An identification device of a socket or a tube wrench comprising:

a female recess of the socket or the tube wrench having a bottom with a nut engaging surface for receipt of a nut, and a planar surface or a pellet fit completely inside the female recess and spanning without a hole across the recess, the pellet being secured only by friction in the female recess between a lateral surface of the planar surface or the pellet and an inner wall of said female recess at the bottom of the recess, the pellet having a same shape as a cross section of the female recess, the pellet having side surfaces extending orthogonal relative to an upper and lower face of the pellet, and said pellet having indicia identifying a size of the female recess.

6. The identification device of claim 5, wherein said pellet includes a convex upper face and a concave lower face.

7. The identification device of claim 6, wherein said pellet is semi-rigid.

8. The identification device of claim 7, wherein a distance separating two opposite apices of one of two faces of the pellet is slightly greater than a distance separating two opposite apices of a cross section of the female recess.

9. The identification device of claim 6, wherein said pellet is reversible.

10. The identification device of claim 9, wherein information relative to dimensions of said female recess is inscribed on two faces of the pellet.

11. The identification device of claim 5, wherein said pellet includes a thickness of very small dimensions with respect to a distance separating two opposite apices of a face of the pellet.

12. The identification device of claim 5, wherein said pellet extends in a plane perpendicular to a clamping axis.

13. The identification device of claim 5, wherein said pellet is made of plastics material.

14. The identification device of claim 5, wherein said pellet is made of metallic material.

15. The identification device of claim 5, wherein the female recess and the pellet are of hexagonal shape.

16. The identification device of claim 5, wherein said pellet includes a multi-layer material, the multi-layer material having a layer of one of plastics and metallic material, at least one layer of ink and a layer of protective material.

17. The identification device of claim 5, wherein said pellet has a thickness between 0.1 and 1.5 mm.

* * * * *